US006695648B2

(12) United States Patent
Liao

(10) Patent No.: US 6,695,648 B2
(45) Date of Patent: Feb. 24, 2004

(54) SUPPORTING AND SKIDPROOF STRUCTURE OF CAR LIGHTER PLUG

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/188,916

(22) Filed: Jul. 5, 2002

(65) Prior Publication Data

US 2004/0005819 A1 Jan. 8, 2004

(51) Int. Cl.[7] ..... H01R 24/04
(52) U.S. Cl. ..... 439/668
(58) Field of Search ..... 439/668, 669

(56) References Cited

U.S. PATENT DOCUMENTS 5,387,136 A * 2/1995 Britton ..... 439/668
5,704,812 A * 1/1998 Moji ..... 439/668
5,775,952 A * 7/1998 Lu ..... 439/668
5,860,824 A * 1/1999 Fan ..... 439/265
5,924,895 A * 7/1999 Moji ..... 439/668
6,443,774 B1 * 9/2002 Ou ..... 439/668
6,478,628 B1 * 11/2002 Ming ..... 439/668
6,551,142 B2 * 4/2003 Eisenbraun ..... 439/668

* cited by examiner

*Primary Examiner*—Tulsidas Patel
(74) *Attorney, Agent, or Firm*—Birch, Stewart, Kolasch & Birch, LLP

(57) ABSTRACT

The present invention provides a supporting and skidproof structure of car lighter plug, which comprises a plug body having an insertion portion, an elastic conducting post matched at the front end of the insertion portion, a plurality of elastic conducting sheets protruding out of the sidewall of the insertion portion, and a support unit disposed on the plug body. The support unit has a support component, which can be controlled to make outward spreading or inward retraction. Thereby, the car lighter plug can be supported and firmly positioned in a car lighter insertion hole, and will not skid or sway, hence achieving good electric connection.

6 Claims, 6 Drawing Sheets

SUPPORTING AND SKIDPROOF STRUCTURE OF CAR LIGHTER PLUG

FIELD OF THE INVENTION

The present invention relates to a supporting and skidproof structure of car lighter plug and, more particularly, to a car lighter plug capable of being inserted into a car lighter insertion hole to transmit electricity to a lighter, a charger, or an electronic device connected to the car lighter plug. The supporting and skidproof structure of car lighter plug can support the car lighter plug to let it be firmly positioned in the car lighter insertion hole so as to prevent the car lighter plug from skidding.

BACKGROUND OF THE INVENTION

As shown in FIG. 1, a conventional car lighter plug has an insertion portion 10*a*, which has an elastic conducting post disposed at the front end thereof. Projective elastic conducting sheets 12*a* are disposed at the side face of the insertion portion 10*a*. The insertion portion 10*a* can be inserted into a car lighter insertion hole 20*a* to let the elastic conducting post 11*a* and the elastic conducting sheets 12*a* of the insertion portion 10*a* achieve electric connection with corresponding conducting terminals 21*a* in the car lighter insertion hole 20*a* so that electricity can be transferred to the car lighter plug. The car lighter plug can also be connected to a lighter, a charger, or an electronic device so that electricity can be transferred to the lighter, the charger, or the electronic device.

However, in the above car lighter plug, the side face of the insertion portion 10*a* only uses the elastic conducting sheets 12*a* to contact an inner wall 22*a* of the insertion hole 20*a*. Moreover, because the elastic conducting sheets 12*a* has resiliency, a good supporting effect cannot be achieved so the car lighter plug cannot be firmly positioned in the car lighter insertion hole 20*a*. The car lighter plug may easily skid and sway, resulting in a bad electric connection.

Accordingly, the above conventional car lighter plug has inconvenience and drawbacks in practical use. The present invention aims to resolve the problems in the prior art.

SUMMARY OF THE INVENTION

The primary object of the present invention is to provide a supporting and skidproof structure of car lighter plug, wherein a projective support component is disposed on the sidewall of an insertion portion of a plug body. The support component can abut against the inner wall of a car lighter insertion hole to have a good supporting effect so as to support and firmly position the car lighter plug in the car lighter insertion hole. The car lighter plug will not skid or sway, hence achieving good electric connection.

To achieve the above object, the present invention provides a supporting and skidproof structure of car lighter plug, which comprises a plug body having an insertion portion, an elastic conducting post matched at the front end of the insertion portion, a plurality of elastic conducting sheets protruding out of the sidewall of the insertion portion, and a support unit disposed on the plug body. The support unit has a support component, which can be controlled to make outward spreading or inward retraction.

The various objects and advantages of the present invention will be more readily understood from the following detailed description when read in conjunction with the appended drawing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
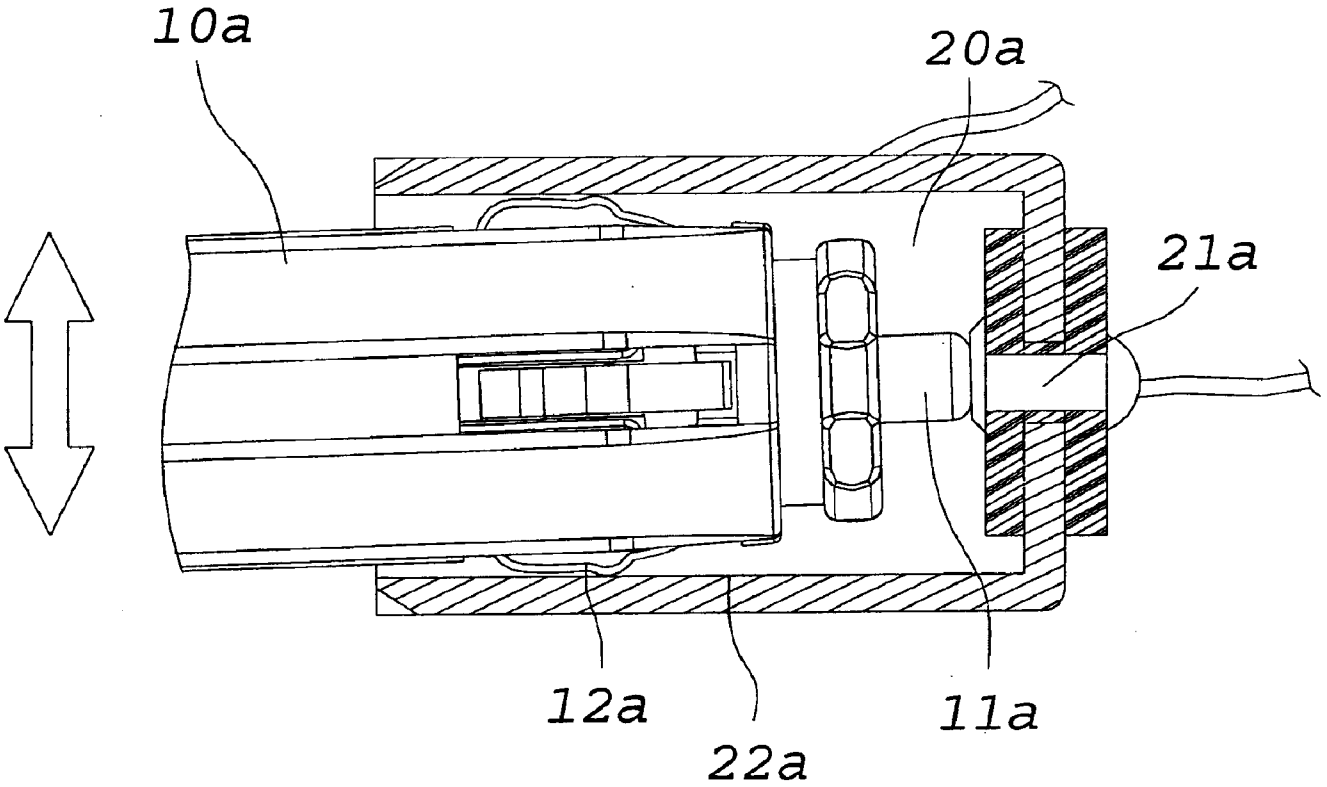
FIG. 1 BACKGROUND ART
FIG. 1 is a cross-sectional view of a conventional car lighter plug inserted into a car lighter insertion hole.
Figure 2:
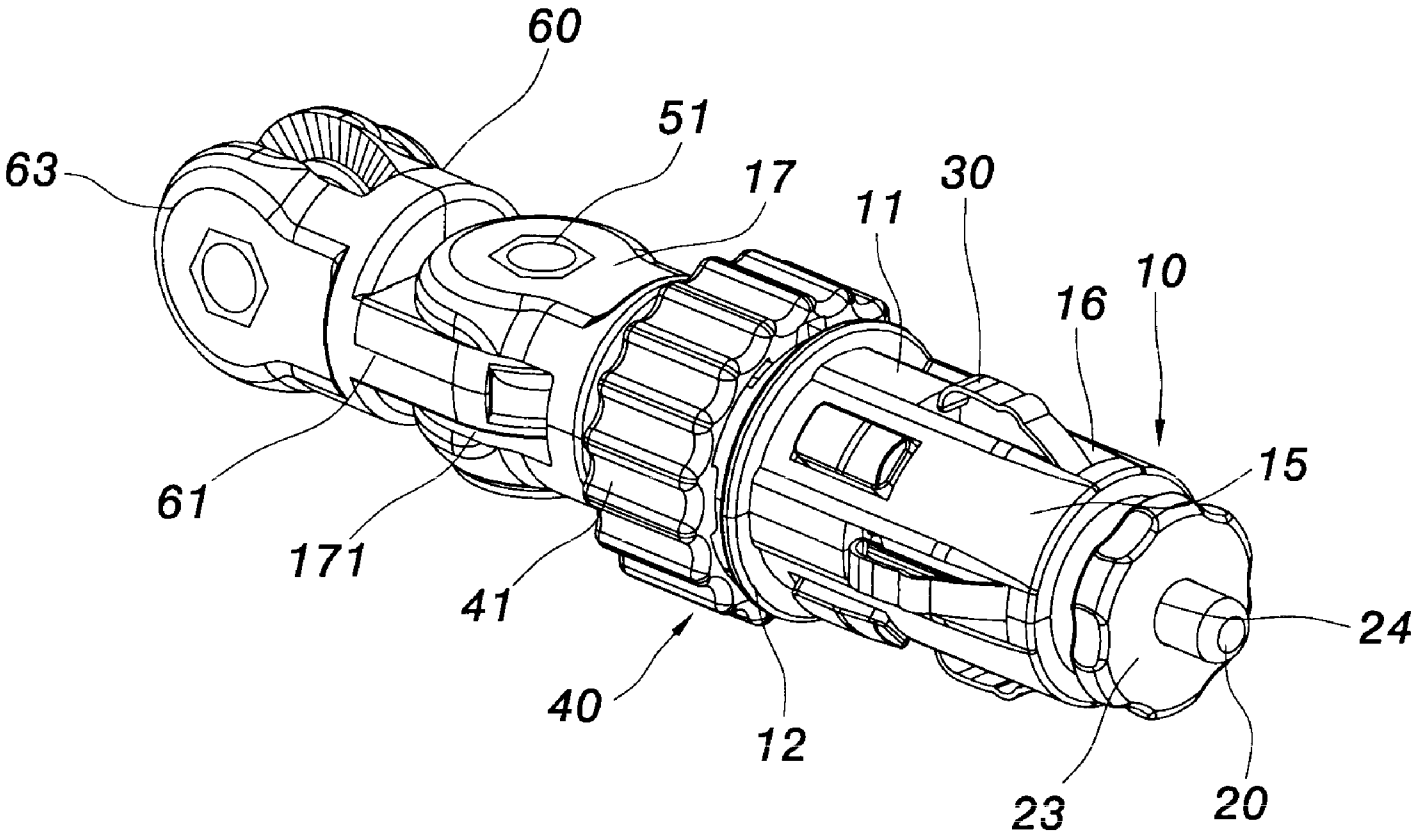
FIG. 2 is a perspective view of the present invention.
Figure 3:
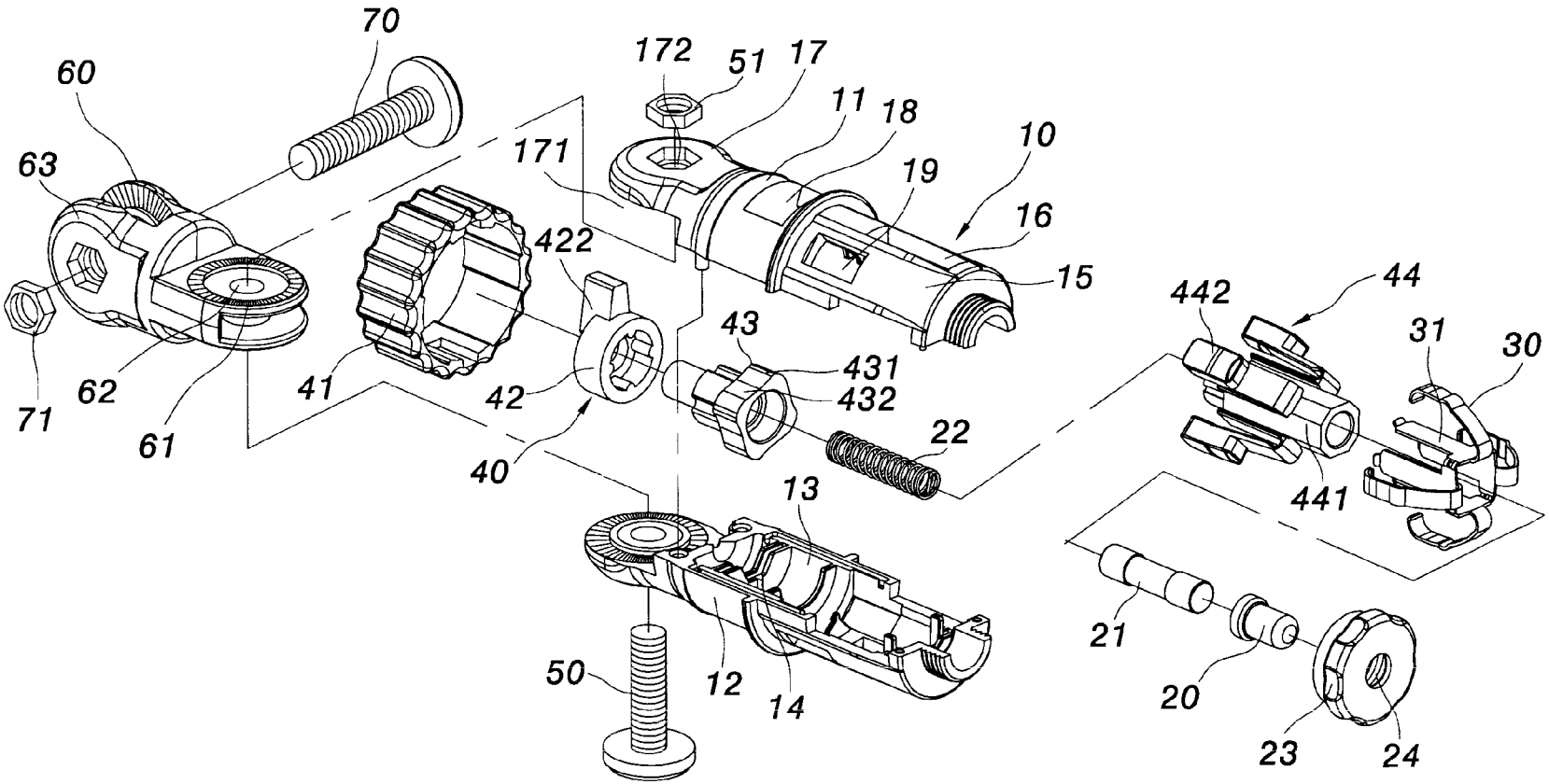
FIG. 3 is an exploded perspective view of the present invention.
Figure 5:
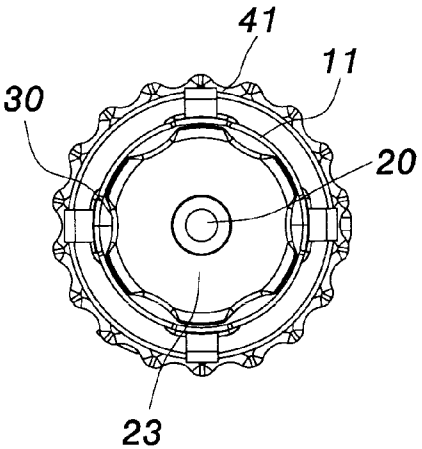
FIG. 5 is a front view of the present invention.
Figure 4:
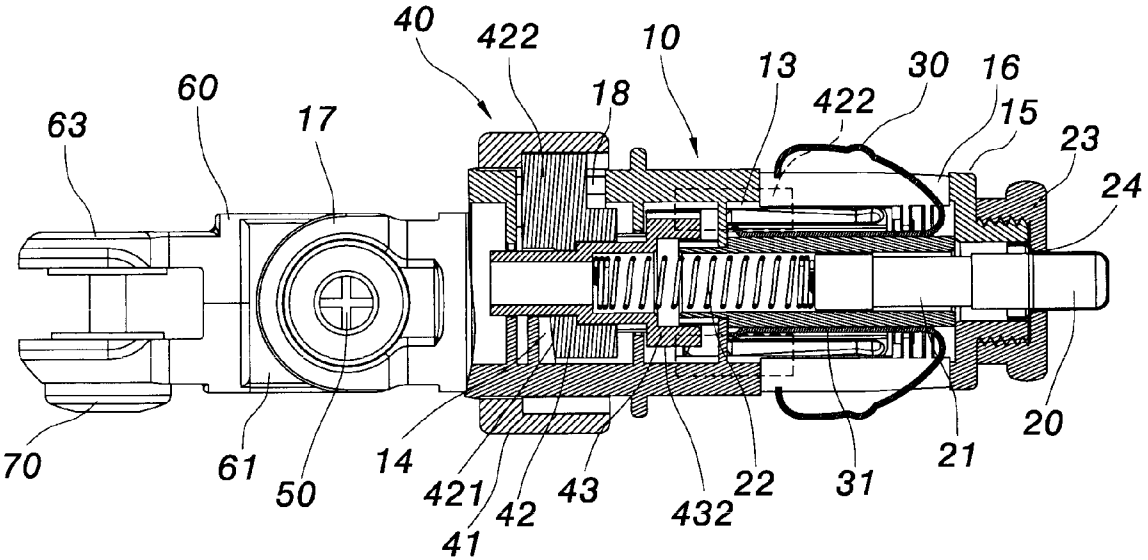
FIG. 4 is a cross-sectional view of the present invention.

As shown in FIGS. 2 to 5, the present invention provides a supporting and skidproof structure of car lighter plug, which comprises a plug body 10, an elastic conducting post 20, a plurality of elastic conducting sheets 30, and a support unit 40. The plug body 10 is composed of a first half shell 11 and a second half shell 12. The first half shell 11 and the second half shell 12 are two opposite semi-cylindrical hollow shell bodies, which can be assembled to form the plug body 10 of cylindrical hollow shell shape. The plug body 10 has a receiving space 13 therein. The receiving space 13 has a positioning body 14 of triangular pyramidal shape therein. The plug body 14 has also a cylindrical insertion portion 15, whose outer diameter is equal to the inner diameter of a car lighter insertion hole (not shown).

The elastic conducting post 20 is made of metal material. The elastic conducting post 20 is retractably and slidably matched at the front end of the insertion portion 15. The rear end of the elastic conducting post 20 has a safety fuse 21 and a spring 22 arranged in order. The spring 22 is used to abut against the safety fuse 21 and the elastic conducting post 20 so as to let the elastic conducting post 20 elastically protrude out of the front end of the insertion portion 15. A screw nut is screwed to the front end of the insertion portion 15 to position the elastic conducting post 20 and prevent the elastic conducting post 20 from leaving the front end of the insertion portion 15. The center of the screw nut 23 has a through hole 24. The front end of the elastic conducting post 20 passes through the through hole 24 and protrudes a predetermined length out of the front end of the screw nut 23.

The elastic conducting sheets 30 are made of metal material. The inner end of the elastic conducting sheets 30 is connected with a connection portion 31. The elastic conducting sheets 30 are integrally formed with the connection portion 31. The connection portion 31 is disposed in the receiving space 13 of the plug body 10. A plurality of first cavities 16 corresponding to the elastic conducting sheets 30 are formed on the sidewall of the plug body 10 so that the elastic conducting sheets 20 can pass through the first cavities 16 and protrude out of the sidewall of the insertion portion 15.

The spring 22 at the rear end of the elastic conducting post 20 and the elastic conducting sheets 30 are electrically connected to a lighter, a charger, or an electronic device to be connected to the car lighter plug. The insertion portion 15 of the plug body 10 can be inserted into a car lighter insertion hole. The elastic conducting post 20 and the elastic conducting sheets 30 on the insertion portion 15 are used to achieve electric connection with corresponding conducting terminals in the car lighter insertion hole, thereby letting electricity be transmitted to the car lighter plug.

The plug body 10 has a first pivotal seat 17 at the rear end thereof. The center of the pivotal seat 17 has a groove. 171. The first pivotal seat 17 has a transversal first through hole 172. The first through hole 172 vertically intersects the groove 171. The first pivotal seat 17 of the plug body 10 can be connected with a connection seat 60, whose front end has a second pivotal seat 61. The second pivotal seat 61 is a flat body corresponding to the groove 171. The second pivotal seat 61 can be inserted into the groove 171. The second pivotal seat 61 has a transversal second through hole 62 corresponding to the first through hole 172. The other end of the connection seat 60 can be connected with a device like a lighter, a charger, or an electronic device according to practical necessity.

The plug body 10 and the connection seat 60 are connected together using a screw 50. The screw 50 passes through the first through hole 172 of the plug body 10 and the second through hole 62 of the connection seat 60, and is then screwed to a screw 50 for fixation. The plug body 10 and the connection seat 60 can thus make relative rotation with the screw 50 as the axis to form a joint structure whose angular position can be adjusted so that a user can adjust different angles of a lighter, a charger, or an electronic device according to practical necessity to facilitate use.

The rear end of the connection seat 60 can also has a third pivotal seat 63, whose structure is the same as that of the first pivotal seat 17. The third pivotal seat 63 is also connected with another screw 70 and another screw nut 71 so as to connect a lighter, a charger, or an electronic device, thereby forming a double-pivot car lighter plug, whose angular position can be adjusted more flexibly.

The support unit 40 comprises an adjustment knob 41, a stop component 42, a push component 43, and a support component 44. The adjustment knob 41 is a circular ring body, which is slipped onto the plug body 10 and can make free rotation and forward and rearward motion to let the support unit 44 make outward spreading or inward retraction.

The stop component 42 is disposed in the receiving space 13 of the plug body 10. The rear end of the stop component 42 has a plurality of positioning teeth 421 (shown in FIG. 4), which engage the positioning bodies 14 in the plug body 10 so that the stop component 42 cannot be turned. The stop component 42 has also a retaining portion 422, which protrudes out of a second cavity 18 formed on the sidewall of the plug body 10. The retaining portion 422 is also retained with the inner wall of the adjustment knob 41 to connect the adjustment knob 41 and the stop component 42 together.

The push component 43 is disposed in the receiving space 13, and is roughly a quadratic body. The push component 43 has several projective portions 431 and recessed portions 432, which are cross and alternately arranged. The distance from the projective portions 431 to the axis of the push component 43 is larger than that from the recessed portions 432 to the axis of the push component 43. The push component 43 is retained with the stop component 42 to let the adjustment knob 41, the stop component 42, and the push component 43 be connected together. The rear end of the spring 22 abuts against the push component 43 to let the adjustment knob 41, the stop component 42, and the push component 43 have backward restoring force. The positioning teeth 421 of the stop component 42 can thus exactly engage the positioning bodies 14 in the plug body 10.

The support component 44 is disposed in the receiving space 13 of the plug body 10. The support component 44 has a main body 441. A plurality of elastic support bodies 442 are alternately disposed at the outside of the main body 441. The elastic support bodies 442 can make free inward and outward swing. The elastic support bodies 442 are disposed at the outer periphery of the push component 43. The projective portions 431 or the recessed portions 432 of the push component 43 can selectively correspond to the elastic support bodies 442 so as to let the elastic support bodies 442 make outward or inward swing. When the elastic support bodies 442 make outward swing, they can protrude out of the third cavity 19 formed on the sidewall of the plug body 10. A supporting and skidproof structure of car lighter plug of the present invention is thus formed.

Figure 7:
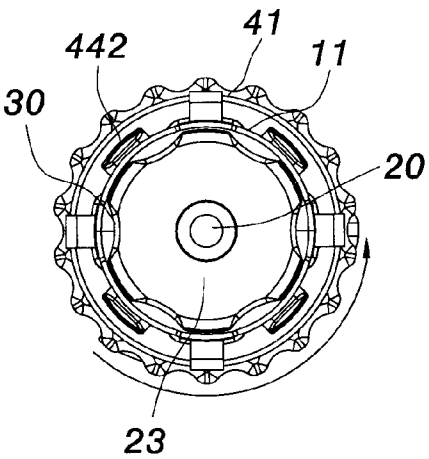
FIG. 7 is a front view showing the supporting state of the present invention.
Figure 6:
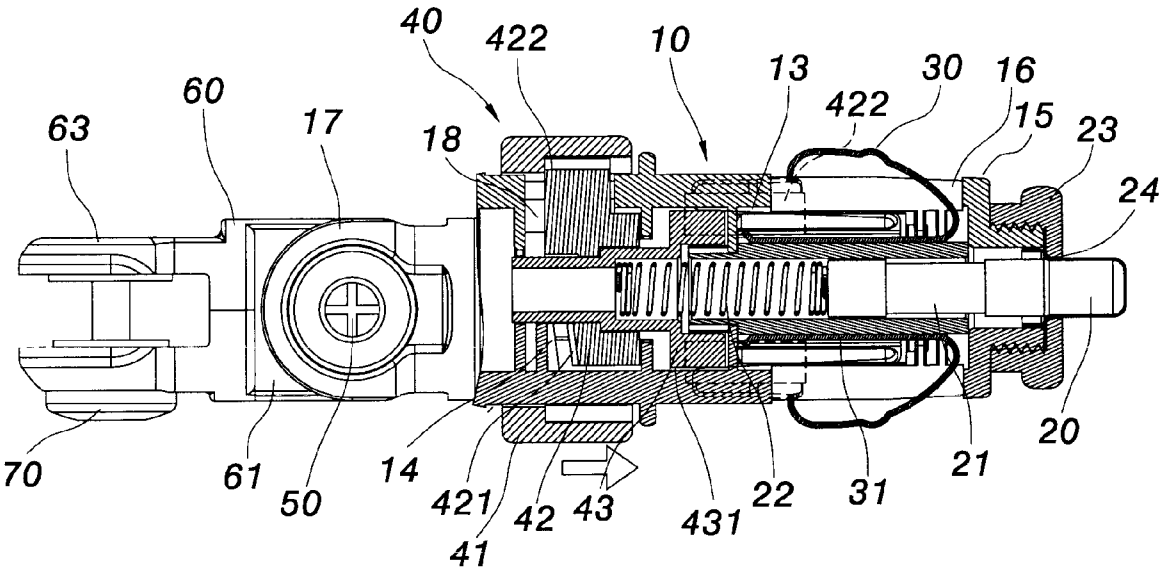
FIG. 6 is a cross-sectional view showing the supporting state of the present invention.
Figure 8:
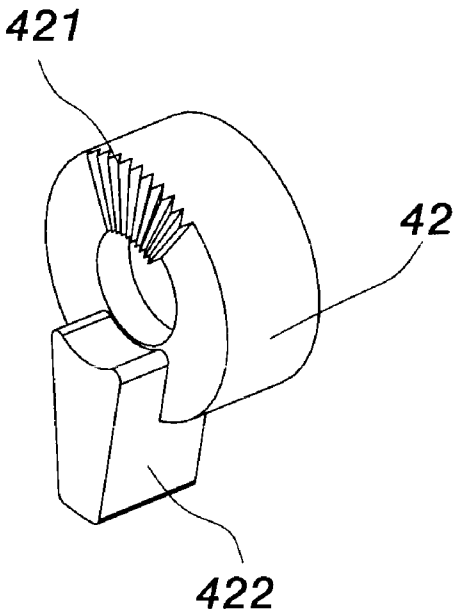
FIG. 8 is a perspective view of a stop component of the present invention.

When in use, a user first inserts the car lighter plug into a car lighter insertion hole (not shown), and then pushes forwards the adjustment knob 41 (as shown in FIGS. 6 and 7) to jointly let the stop component 42 and the push component 43 move forwards so as to separate the positioning teeth 421 of the stop component 42 from the positioning bodies 14 in the plug body 10. The adjustment knob 41 can thus be turned to jointly turn the stop component 42 and the push component 43 an appropriate angle so that the projective portions 431 of the push component 43 can correspond to and abut against the inside of the elastic support bodies 442 of the support component 44. The elastic support bodies 442 will thus swing outwards and spread to protrude out of the insertion portion 15 of the plug body 10. When the user releases the force for pushing forwards the adjustment knob 41, the restoring force of the spring 22 will let the stop component 42 and the push component 43 move backwards to engage the positioning teeth 421 of the stop component 42 with the positioning bodies 14 in the plug body 10. The adjustment knob 41 can thus be fixed to keep the elastic support bodies 442 at an outspread state.

When the user wants to pull out the car lighter plug, he pushes forwards the adjustment knob 41 to jointly let the stop component 42 and the push component 43 move forwards so as to separate the positioning teeth 421 of the stop component 42 from the positioning bodies 14 in the plug body 10. The adjustment knob 41 can thus be turned to jointly turn the stop component 42 and the push component 43 an appropriate angle so that the recessed portions 432 of the push component 43 can correspond to the inside of the elastic support bodies 442 of the support component 44. The elastic support bodies 442 will thus swing inwards and retract into the insertion portion 15 of the plug body 10, thereby facilitating extraction of the car lighter plug.

To sum up, in addition to using the elastic conducting sheets 30 to contact the inner wall of a car lighter insertion hole, the elastic support bodies 442 of the support component 44 are provided. The elastic support bodies 442 can protrude out of the sidewall of the insertion portion 15 of the plug body 10 and abut against the inner wall of the insertion wall to achieve good supporting effect. The car lighter plug can thus be firmly positioned in the car lighter insertion hole, and will not skid or swing, hence achieving good electric connection.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A supporting and skidproof structure of car lighter plug, comprising:

a plug body having an insertion portion;

an elastic conducting post matched at a front end of said insertion portion;

a plurality of elastic conducting sheets protruding out of a sidewall of said insertion portion; and a support unit disposed on said plug body, said support unit having a support component, which can be controlled to make outward spreading or inward retraction, the support unit includes an adjustment knob sleeved onto said plug body and is rotatable and forwardly and rearwardly movable.

2. The supporting and skidproof structure of car lighter plug as claimed in claim 1, wherein said plug body is composed of a first half shell and a second half shell, said first and second half shells are two opposite semi-cylindrical hollow shell bodies, which can be assembled to form said plug body of cylindrical hollow shell shape.

3. The supporting and skidproof structure of car lighter plug as claimed in claim 1, wherein a connection seat is connected at a rear end of said plug body.

4. The supporting and skidproof structure of car lighter plug as claimed in claim 1, wherein a rear end of said elastic conducting post has a safety fuse and a spring arranged in order, a front end of said insertion portion is screwed to a screw nut for positioning said elastic conducting post, a through hole is formed at the center of said screw nut, a front end of said elastic conducting post passes through said through hole and protrudes out of a front end of said screw nut.

5. The supporting and skidproof structure of car lighter plug as claimed in claim 1, wherein an inner end of said elastic conducting sheets is connected with a connection portion disposed in said plug body, a plurality of first cavities corresponding to said elastic conducting sheets are formed on the sidewall of said plug body so that said elastic conducting sheets can pass through said first cavities and protrude out of the sidewall of said insertion portion.

6. The supporting and skidproof structure of car lighter plug as claimed in claim 1, wherein said support unit further comprises, a stop component and a push component connected together, said adjustment knob is slipped onto said plug body, said stop component is disposed in said plug body and has a plurality of positioning teeth, a plurality of positioning bodies are disposed in said plug body, said positioning teeth of said stop component engage said positioning bodies in said plug body, said push component is disposed in said plug body and has a plurality of projective portions and recessed portions, which are cross and alternately arranged, a spring is also provided to abut against said push component to let said adjustment knob, said stop component, and said push component have rearward restoring force, said support component is disposed in said plug body and has a plurality of alternately arranged elastic support bodies, said elastic support bodies can make inward and outward swing, said elastic support bodies are disposed at an outer periphery of said push component, said projective portions or said recessed portions of said push component can selectively correspond to said elastic support bodies.

* * * * *